United States Patent [19]

Chen

[11] Patent Number: 4,552,107

[45] Date of Patent: Nov. 12, 1985

[54] ROTARY INTERNAL COMBUSTION ENGINE

[76] Inventor: Chin L. Chen, No. 1, Alley 20, La. 99, Wan-Shou Rd., Sec. 3, Tao-Yuan, Taiwan

[21] Appl. No.: 564,010

[22] Filed: Dec. 21, 1983

[51] Int. Cl.[4] ..... F02B 53/00

[52] U.S. Cl. ..... 123/240; 418/3; 418/6; 418/173

[58] Field of Search ..... 123/221, 226, 239, 240; 418/3, 6, 9, 11, 173

[56] References Cited

U.S. PATENT DOCUMENTS

| | | | |
|---|---|---|---|
| 1,462,848 | 7/1923 | Berry | 123/240 |
| 1,473,656 | 11/1923 | Wagenhorst | 418/173 X |
| 1,969,192 | 8/1934 | Williams et al. | 418/173 X |
| 3,008,457 | 11/1961 | Mezzetta | 123/240 |
| 3,976,037 | 8/1976 | Hojnowski | 123/240 |
| 4,078,526 | 3/1978 | Gail | 123/226 |

*Primary Examiner*—Michael Koczo

*Attorney, Agent, or Firm*—Toren, McGeady, Stanger, Goldberg & Kiel

[57] ABSTRACT

A rotary engine is comprised of at least one rotor assembly including a drum rotor and a cylinder rotor in internal contact with the drum rotor. The drum rotor bounds, with the cylinder rotor, and a crescent shaped working chamber and an annular working chamber, with the inner surface of the housing. The annular working chamber includes a first segmented annulus portion, a second segmented annulus portion of greater width than the first portion, and a transition portion of gradually increasing width connecting one end of first and second segmented annulus portions. A portion of the inner surface of the housing is inwardly projected between another end of first and second segmented annulus portions to come into contact with the periphery of the drum rotor. In the annular chamber is a further vane which is pivoted to the drum rotor to swing about an axis parallel to the axis of the drum rotor so as to intermittently interrupt communication between the crescent shaped chamber and annular chamber as well as to run expansion and exhaust strokes simultaneously.

9 Claims, 8 Drawing Figures

ROTARY INTERNAL COMBUSTION ENGINE

BACKGROUND OF THE INVENTION

This invention relates to an internal combustion engine of rotary type, particularly to a rotary engine which includes at least one rotary assembly including an inner cylindrical rotor mounted in a drum rotor in an internal contact position and in which the associated rotors bound a crescent shaped working chamber and the inner wall of the housing and the drum rotor bound a working chamber constituted of segmented annulus portions of different widths.

Various forms of internal combustion rotary engine have existed in the arts. U.S. Pat. No. 1,462,848 discloses a rotary engine which includes three drum rotors of different diameters and two crescent shaped working chambes and in which a hollow vane radially passes through the walls of the drum rotors for dividing both crescent shaped chambers and driving fluid entering therethrough. In U.S. application Ser. No. 354,718 filed on Mar. 4, 1982 in the name of this inventor, and now abandoned, there is disclosed a rotary engine in which two drum rotors are externally contacted together and two cylindrical rotors are respectively mounted in the drum rotors in internal contact positions for bounding two crescent shaped working chambers, two intersecting annulus chambers being formed between the inner walls of the housing and the drum rotors. Communication means for the crescent shaped chambers and annulus chambers are provided in the extremities of the inner vanes. This application is to provide an improvement to the inventor's prior application.

SUMMARY OF THE INVENTION

According to the invention, an internal combustion engine of rotary type comprises, at least one rotor assembly having a drum rotor and a cylinder rotor in an internal contact relationship with the drum rotor cooperatively mounted for rotation in a housing, wherein the drum rotor and cylinder rotor bound a first chamber of crescent shape, and the inner surfaces of the housing and the drum rotor bound a second chamber of annular form which includes a first segmented annulus portion and a second segmented annulus portion of greater radial width than and upstream of the first annulus portion. The drum rotor is provided with a radial opening for communication between the first and second chambers. In the first chamber is provided a first vane member for compressing the gas-fuel mixture during rotation. A second vane member is pivotally mounted at the opening of the drum rotor for swinging about an axis parallel to the axes of rotation of said rotors so that it can intermittently interrupt communication between the first and second chambers. The opening is opened when the second vane member runs in the second segmented annulus portion and is closed when the second vane member runs in the second segmented annulus portion.

The opening of the drum rotor is defined by two longitudinal faces and two transverse faces and the second vane member which is mounted therein has at least three axial vane edges and three vane faces. One of the edges is pivoted closely adjacent to one of the longitudinal faces, and one of the vane faces opposite to the pivoted edge is an arc face having its center at the pivot axis of the pivoted vane edge and having its radius equal to a distance from the pivot axis to another longitudinal face. One of the vane edges adjacent to the opposite vane face is engaged with the inner surface of the housing.

Advantageously, the first and second segmented annulus portions of the second chamber are interconnected by a transition portion of gradually increasing width at the downstream end of the second segmented annulus portion or at the upstream end of the first segmented annulus portion. The inner surface of the housing has a portion inwardly projected to come into contact with the periphery of the drum rotor, said portion having two curved surfaces respectively bounding the upstream end of the second annulus portion and the downstream end of the first annulus segmented portion.

An object of the invention is to provide an internal combustion engine of rotary type of simplified construction.

The manner in which the above and related objects are accomplished together with the attending advantages and features of the invention appear more fully from the following detailed description and drawings.

DETAILED DESCRIPTION OF THE PREFERRED EMBODIMENTS

Figure 1:
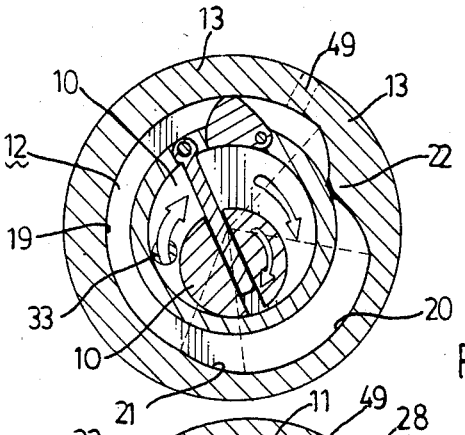
FIGS. 1, 2, 3 and 4 are schematic sectioned views of a first embodiment of an internal combustion engine in different conditions.
Figure 2:
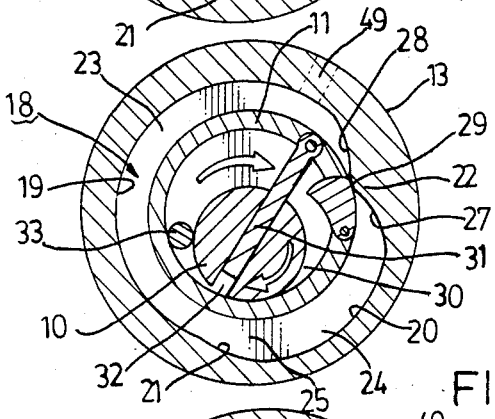
Figure 3:
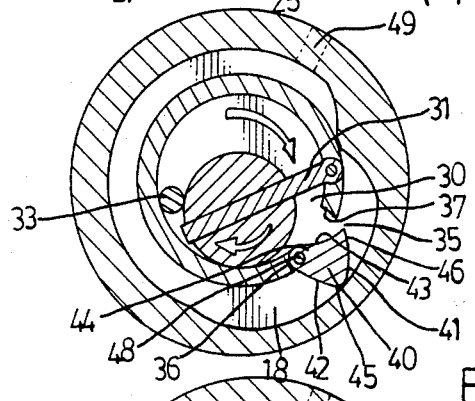
Figure 4:
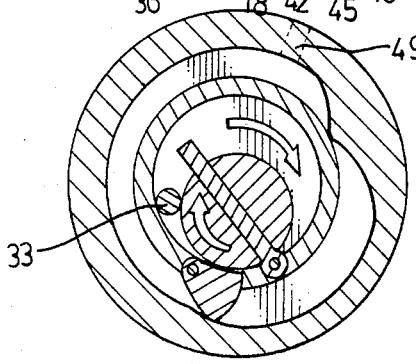

Now referring to FIGS. 1, 2, 3, 4 and 5, there is shown a first embodiment of the invention in which a cylinder rotor 10 and a drum rotor 11 are eccentrically mounted in a cavity 12 of a housing 13 which is constituted of a cylindrical body 14, and upper and lower covers 15 and 16. Rotor 10 is located inside rotor 11 and in contact with the internal surface of rotor 11. The rotor 10 is carried by a shaft 17 which is journalled in the covers 15 and 16. The cavity 12 of the housing 13 includes two sectors 19 and 20 (shown by dotted lines in FIG. 1), the sector 20 being greater in radius than the sector 19. The arcs of the sectors 19 and 20 are interconnected by a curved face 21 so that there is a gradually changing surface between two arcs of the sectors 19, 20. The inner surface of the housing 13 has a portion 22 inwardly projected to come into contact with the periphery of the drum rotor 11. The periphery of the drum rotor 11 and the inner surface of the housing bound an annular working chamber 18 including a first segmented annulus portion 23 in the sector 19, a second segmented annulus portion 24 of greater width than the first portion 23 in the sector 20 and a transition portion 25 of gradually increasing width connecting the portions 23 and 24. The second segmented annulus portion 24 is upstream from the first portion 23.

Figure 5:
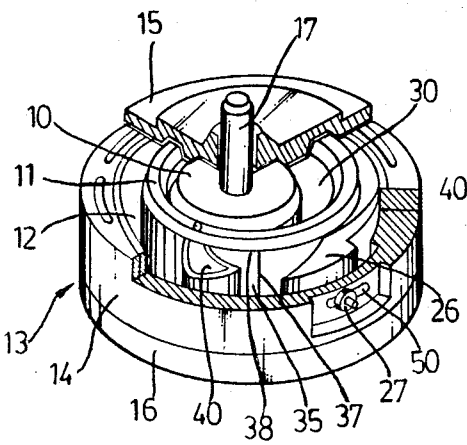
FIG. 5 is a schematic perspective view of the first embodiment.

The inwardly projected portion 22 can be formed by properly designing the cavity 12 during fabricating the housing 13 or providing a block member 26 between the inner surface of the housing and the periphery of the drum rotor 11 as better shown in FIG. 5. The member 26 is fixed to the inner surface of the housing by means of a screw 27. This portion 22 has two curved faces 27 and 28 respectively bounding the upstream end of the second segmented annulus portion 24 and the downstream end of the first segmented annulus portion 23, and has an end face 29 in close contact with the periphery of the drum rotor 11.

The drum rotor 11 and the cylinder rotor 10 bound a working chamber 30 of crescent shape in which the air-fuel mixture is compressed. A vane member 31 is pivoted to the wall of the drum rotor 11 and is received slidably in a bore 32 diametrically open through the periphery of the rotor 10. It is known that the upper and lower sides of the vane member 31 are in contact with the inner surfaces of the housing 13 is fluid tight relationship. The vane member 31 divides the working chamber 30 into two rooms the volumes of which are variable during rotation of the vane member 31. An intake port 33 is provided in the wall of the housing 13 and axially communicated with the chamber 30.

On the wall of the drum rotor 11 is provided a longitudinal opening 35 defined by two radial faces 36 and 37 and two transverse faces 38 (upper and lower faces as shown in FIG. 5) for communicating the chamber 30 and the annular chamber 18. This opening 35 is alternately closed and opened by a vane member 40 which rotates in the annular chamber 18. The vane 40 substantially has three vane faces 41, 42 and 43, and has three vane edges 44, 45 and 46. It is pivoted to the drum rotor 11 with its edge 44 which is round and closely adjacent to the longitudinal face 36 which has a profile that can be kept in sealing contact relationship with the slightly movable round edge 44. The vane face 41 opposite to the vane edge 44 has an arc face which has its center at the pivot axis 48 of the edge 44 and has its radius equal to the distance from the pivot axis 48 to the face 37 which has a curvature similar to that of the vane face 41, and therefore the face 41 can sealingly engaged with the face 37 upon swinging movement of the vane member 40. It can be appreciated (FIG. 5) that the upper and lower sides of the vane 40 is closely adjacent to the inner surfaces of the housing 13 or the transverse faces 38.

The vane edge 45 which is adjacent to the vane face 41 has a slightly curved edge face and is sealingly engaged with the inner surface of the housing when the vane 40 is acted by the combustion or explosion gases. Preferably, the vane face 42 is convexed and the vane face 43 is concaved. When the vane 40 is rotated in the first segmented annulus portion 23 the vane 40 is sealingly engaged with the longitudinal face 37 and when the vane face 41 is rotated in the second segmented annulus portion 24 the vane face 41 is departed from the face 37, thereby placing the opening 35 in an open position.

In the operation, the vanes 31 and 40 are rotated clockwise respectively in the chambers 30 and 18. When the vane 31 sweeps the intake port 33, the air-fuel mixture is drawn in the chamber 30 behind it and the gas-fuel mixture previously trapped at the front of the vane 31 is compressed by the vane 31. It can be noted that the vane 31 lags some degree in the angular direction behind the vane 40 and therefore the opening 35 communicates the chamber 18 and the variable volume region, i.e. compression region, at the front of the vane 31. During rotation, the vane 40 alternately runs in the first and second segmented annulus portions 23 and 24, and the opening 35 is intermittently closed by the vane 40 when it runs in the first portion 24. When the vane 40 reaches the end face 29 of the inner surface portion 22 of the housing 13, the vane edge 45 thereof is depressed flush with the periphery of the drum rotor 11. At this time, a portion of the vane 40 enters into the compression region of the chamber 30, thereby rendering further volume contraction of the compression region. After the vane edge 45 passes the end face 29 of the portion 22 the vane 40 which gets into the second portion 24 is caused to open. The compressed air-fuel mixture which is ignited by a spark plug or by a wire (not shown) in the compression region explodes and rushes into the second segmented annulus portion 24 and acts on the vane 40. The compression ratio of the engine depends on the time at which the vane 40 is opened. This is to say, it depends on the location of the end face 29 of the portion 22. The vane edge 45 of the vane 40 is sealingly engaged with the inner surface of the housing 13 by the force of the explosion gases. It slides smoothly from the second portion 24 to the first portion 23 through the curved face 21 of the transition portion 25 and gets into a closed position in the first portion 23. At the downstream end of the first segmented annulus portion 23, the combustion gases escape through an exhaust port 49 which is radially communicated with the downstream portion of the first segmented annulus portion 23.

It can be appreciated from FIG. 5 that location of the end face 29 of the portion 22 can be varied by displacing the screw 27 in the guide groove 50, and accordingly the pressure of the finally compressed air-fuel mixture which may be deviated from the predetermined value after a long time service of the engine can be adjusted easily.

Figure 6:
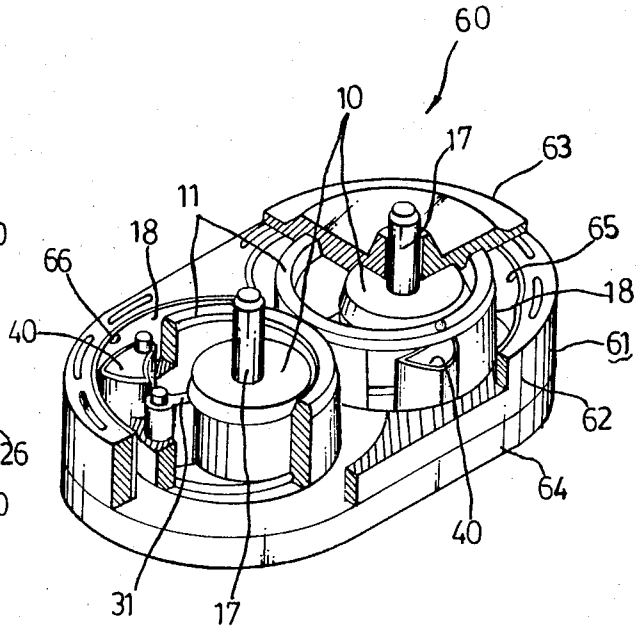
FIG. 6 is a schematic perspective view of a second embodiment.
Figure 7:
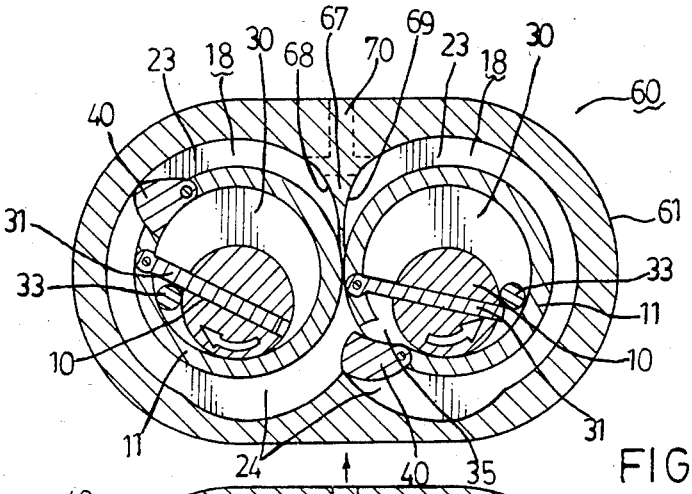
FIGS. 7 and 8 are schematic sectioned views of the second embodiment in different conditions.
Figure 8:
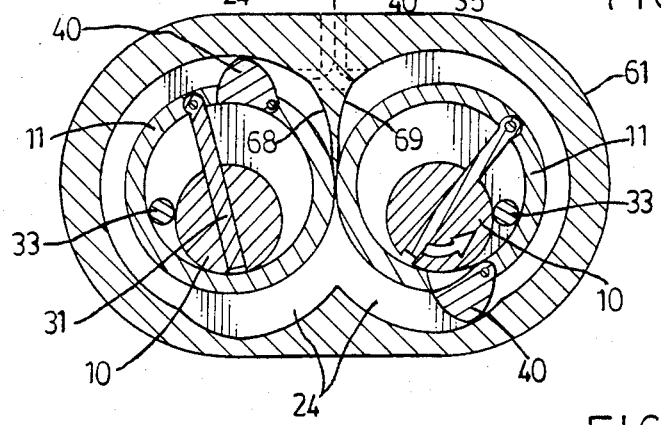

The second embodiment of the invention is illustrated with reference to FIGS. 6, 7 and 8 in which elements which are in the same construction and perform in the same manner as those of the first embodiment are represented by the same numerals as those of the first embodiment.

As shown in the figures, the rotary engine 60 includes two rotor assemblies each of which has a cylinder rotor 10 and a drum rotor 11. Two drum rotors 11 are externally contacted and mounted cooperatively with the rotors 10 in a housing 61 which is constituted of a body 62, upper and lower covers 63 and 64. The two rotors 10 are respectively mounted on two parallel shafts 17 which are journalled in the covers 63 and 64. The housing 61 has two intersecting cavities 65 and 66 and the inner surfaces of the housing and the peripheries of the drum rotors 11 bounds two intersecting chambers 18. Respective second segmented annulus portions 24 of the two chambers 18 intersect at their upstream portion. This is to say, they intersect at the place just downstream of the tangent point of the drum rotors 11. The inner surface of the housing has a portion 67 inwardly projected to come into contact with the peripheries of the drum rotors 11. This portion 67 has two curved faces 68 and 69 bounding two downstream ends of respective two first segmented annulus portions 23 at the place just upstream of the tangent point of the drum rotors 11. An exhaust port 70 is provided on the wall of the housing 61 and radially communicated with the segmented annulus portions 23.

Each of the rotor assemblies has a crescent shape working chamber 30 between the cylinder rotor 10 and drum rotor 11 and has a vane member 31 which is pivoted to the wall of the drum rotor 11 and is slidably mounted in the cylinder rotor 10. Each vane member 31 divides the working chamber 30 into two variable volume regions during rotation therein. Two intake ports 33 are respectively provided in the wall of the housing 61 and axially communicated with the respective chambers 30.

On the walls of the drum rotors 11 are respectively provided two radial openings 35 for communicating chambers 30 and annular chambers 18 respectively. These opening 35 are intermittently closed and opened by two vane members 40 respectively. The two vane members 40 are pivoted to the respective drum rotors 11 in such a manner that one of the vane member 40 lags, preferably 180°, behind the another in the angular motion.

In the operation, two drum rotors 11 rotate in the opposite angular directions and respectively run four stroke operations as described in the first embodiment by cooperating with the respective rotors 10. As one of the vane members 40 lags behind the another, the opening action of one vane is preceded by that of the other and also the ignition time in two rotor assemblies are different. When a vane member 40 of a drum rotor 11 approximates and reaches the tangent point of the drum rotors 11, it is depressed by the portion 67 of the inner surface of the housing 61 and the periphery of another drum rotor 11. After the tangent point the vane member 40 is opened. As the portion 67 has two curved faces 68 and 69 respectively bounding ends of the segmented annulus portions 23 and intersecting the respective peripheries of the drum rotors 11, the vane members 40 can respectively slide along the curve faces 68 and 69, and the sealing effect at the tangent point of the drum rotors 11 can also be increased.

The combustion gases which explodes formerly in one rotor assembly will ignite the compressed air-fuel mixture which subsequently rushes into the intersecting second segmented annulus portions 24 of the chambers 18 from another rotor assembly, through the respective opened vane member 40, and once an ignition is introduced into the rotary engine 60, the engine 60 can run successive cycles of four stroke operation without further ignition.

With the invention thus explained, it is apparent that obvious modifications and variations can be made without departing from the scope of the invention. It is therefore intended that the invention be limited only as indicated in the appended claims.

I claim:

1. An internal combustion engine of the rotary type comprising, a housing, at least one rotor assembly having a first drum rotor and a second cylinder rotor eccentrically mounted for rotation in said housing, said second rotor being located inside said first drum rotor and in contact with the internal surface of said first drum rotor, wherein said first and second rotors bound a first chamber of crescent shape, and the periphery of said first rotor and the inner surfaces of said housing bound a second chamber of annulus shape which includes a first segmented annulus portion, a second segmented annulus portion of greater radial width than and upstream of said first annulus portion, and in which said first rotor has a radial opening for communication between said first and second chambers, intake means for admitting a gas-fuel mixture communicated with said first chamber, exhaust means for releasing the combustion gases communicated with said second member, first vane means pivotally mounted on the wall of said first drum rotor, said first vane means dividing said first chamber into two variable volumes for compressing the gas-fuel mixture during rotation, and second vane means including at least one second vane member pivotally mounted to said first drum rotor in said opening for swinging about an axis parallel to the axes of rotation of said rotors for intermittently interrupting communication between said first and second chambers, said second vane having an edge sealingly engaged with the inner surfaces of said housing, said opening being opened when said second vane member runs in said second segmented annulus portion and being closed when said second vane member runs in said first segmented annulus portion.

2. An internal combustion engine as claimed in claim 1, wherein said first vane means lags some degree behind said second vane means in the angular direction.

3. An internal combustion engine as claimed in claim 2, wherein said opening of said drum rotor is defined by two longitudinal faces and two transverse faces, and in which said vane member has at least three axial vane edges and three vane faces, one of said edges being pivoted closely adjacent to one of said longitudinal faces, one of said vane faces opposite to said pivoted edge being an arc face having its center at the pivot axis of said pivoted vane edge and having its radius equal to a distance from said pivot axis to another said longitudinal face, and one of said vane edges adjacent to said opposite vane face being engaged with the inner surface of said housing.

4. An internal combustion engine according to claim 3, wherein said second chamber further includes a transition portion of gradually increasing width connecting the downstream end of said second segmented annulus portion and the upstream end of said first segmented annulus portion, and in which the inner surface of said housing has a portion inwardly projected to come into contact with the periphery of said first rotor, said portion having two curved surfaces respectively bounding the upstream end of said second annulus portion and the downstream end of said first annulus portion and capable of allowing said second vane member to slide smoothly therealong.

5. An internal combustion engine of rotary type according to claim 3, in which two rotor assemblies are mounted in said housing and wherein two first drum rotors are tangent to and in fluid tight relationship with one another, and the peripheries of said drum rotors and the inner surfaces of said housing bound two intersecting second chambers.

6. An internal combustion engine of rotary type according to claim 5, wherein said second vane means includes two second vane members respectively pivoted to said two drum rotors and in which one of said second vane members lags behind another in the angular direction.

7. An internal combustion engine of rotary type according to claim 6, wherein each of said second chambers further includes a transition portion of gradually increasing width connecting the downstream end of said second segmented annulus portion and the upstream end of said first segmented annulus portion, and in which the inner surface of said housing has a portion inwardly projected to come into contact with the peripheries of said first rotors just upstream of the point where said two first rotors are tangent to one another, said portion having two opposite curved surfaces respectively bounding downstream ends of two first segmented annulus portions of said second chambers.

8. An internal combustion engine of rotary type according to claim 4, wherein said intake means includes an intake port axially communicated with said first chamber, and said exhaust means includes an exhaust port radially communicated with said second chamber near the downstream end of said first annulus portion.

9. An internal combustion engine of rotary type according to claim 7, wherein said intake means includes two intake ports respectively axially communicated with two first chambers, and said exhaust means includes two exhaust ports respectively radially communicated with two second chambers.

* * * * *